United States Patent [19]

Leach, Jr. et al.

[11] 4,284,860

[45] Aug. 18, 1981

[54] TIME DOMAN MEASUREMENT OF MOVING COIL LOUDSPEAKER DRIVER PARAMETERS

[75] Inventors: W. Marshall Leach, Jr., Decatur; Ronald W. Schafer, Atlanta, both of Ga.

[73] Assignee: Georgia Tech Research Institute, Atlanta, Ga.

[21] Appl. No.: 135,085

[22] Filed: Mar. 28, 1980

[51] Int. Cl.[3] ..... H04R 29/00

[52] U.S. Cl. ..... 179/175.1 A

[58] Field of Search ..... 179/175.1 A, 175.1 R, 179/175.2 R, 175.2 C, 175.2 D, 107 R, 175.3 R, 175; 324/57 R, 57 SS, 57 DE, 77 C, 77 CS, 140, 56; 181/139, 140

[56] References Cited

U.S. PATENT DOCUMENTS

| | | | |
|---|---|---|---|
| 3,192,325 | 6/1965 | Smith, Jr. | 179/175.1 A |
| 3,643,156 | 2/1972 | Stewart et al. | 324/57 R |
| 3,705,409 | 12/1972 | Brayton et al. | 179/175.1 A |
| 3,997,724 | 12/1976 | Seebinger | 179/175.1 A |
| 4,039,767 | 8/1977 | Leschek | 179/175.1 A |
| 4,065,647 | 12/1977 | Frye et al. | 179/175.1 A |
| 4,095,057 | 6/1978 | Power et al. | 179/175.1 A |

*Primary Examiner*—Thomas A. Robinson

*Attorney, Agent, or Firm*—Newton, Hopkins & Ormsby

[57] ABSTRACT

A novel method for the measurement of the Thiele-Small small-signal parameters of a moving-coil electromagnetic transducer driver is disclosed. The technique is based on a time domain analysis of the transient response of a loudspeaker voice coil circuit to a current step of excitation. By sampling the damped sinusoidal transient generated by such an excitation, the loudspeaker parameters can be calculated from a linear predictive analysis of the recorded data.

9 Claims, 5 Drawing Figures

TIME DOMAN MEASUREMENT OF MOVING COIL LOUDSPEAKER DRIVER PARAMETERS

BACKGROUND OF THE INVENTION

1. Field of the Invention

The present invention relates in general to a novel method for the measurement of the Thiele-Small small signal parameters of a moving-coil electromagnetic transducer. The measurement method is based on a time domain analysis of the transient response of the loudspeaker voice coil circuit to a current step of excitation. The damped sinusoidal transient generated by such an excitation is sampled and recorded. The loudspeaker parameters are then calculated from a linear predictive analysis of the recorded data.

2. Description of the Prior Art

Fundamental to the successful low frequency design of any loudspeaker system which employs a moving-coil electromagnetic transducer is a knowledge of its Thiele-Small small-signal electroacoustic parameters. In multiway systems, such as two-way and three-way loudspeakers, the low frequency response of the upper frequency drivers (e.g., the mid-range and tweeter units) is not as important a design consideration as that of the woofer. This is because the upper frequency drivers are always crossed over to a lower frequency driver. In the case of the woofer, however, its performance determines the ultimate low frequency response of the system. Therefore, it demands a more careful electroacoustic design.

The system enclosure or box interacts with the woofer to play an important role in the low frequency performance of the system. The proper design of the enclosure for a given driver requires a knowledge of the driver small-signal parameters. With these parameters, the enclosure parameters such as volume, vent tuning frequency in the case of a vented box system, passive radiator design in the case of passive radiator system, etc., can be determined in such a way that the low frequency system response can be accurately controlled for optimum performance. The driver small-signal parameters which must be known are the free-air frequency of resonance, the electrical quality factor, the mechanical quality factor, and the equivalent volume of air which when compressed has the same mechanical spring constant as the driver suspension.

Conventional techniques for the measurement of the small-signal parameters of a driver are based on sinusoidal steady-state measurements. The equipment required to make these measurements includes an impedance bridge, oscillator, frequency counter, voltmeter, and oscilloscope. Measurements are made at three different frequencies, both in free air and with the driver mounted on a sealed box with a known volume. The parameters are calculated from the data obtained. Because the calculations can involve differences between frequencies that are closely spaced, discrepancies can result. In addition, the accuracy of the measurements can be perturbed by the voice-coil inductance which is neglected in the theory but is present in the measurements. There are accurate sinusoidal techniques which can be used to circumvent the effects of the voice-coil inductance that use series-parallel coupled coils in the voice-coil circuit and AC bridge techniques. These tests using advanced methods are difficult and time consuming and as a result are very costly to perform. Additionally, these advanced methods are difficult to automate.

SUMMARY OF THE INVENTION

Accordingly, one object of this invention is to provide a novel technique for the measurement of loudspeaker driver small-signal parameters which is based on the transient response of the driver mechanical system. A current step excitation is used to induce a transient mechanical displacement in the voice-coil position. A digital data acquisition system is then used to record the voltage induced in the voice-coil circuit. From the data obtained, three of the four small signal parameters can be calculated. By repeating the procedure a second time with the driver mounted on a sealed box with a known volume, the fourth parameter can be calculated. Because many sampled data points from the transient waveforms enter into the calculations, the statistical uncertainty of the calculated parameters is low. Because the voice-coil excitation is a current step, the parameters are obtained independently of the voice-coil inductance. The calculations have been experimentally implemented on a digital computer using the linear predictive analysis techniques of digital signal processing theory.

The method of the present invention is simple and can be implemented with a microprocessor configuration. The extremely short time, compared to conventional techniques, that is required to make a measurement on a given driver make the technique adaptable to assembly line testing. In such cases, the mechanical moving mass of the driver is normally accurately controlled so that the need to make the second measurement can be eliminated. Thus it is conceptually possible to document the parameters of each driver on an assembly line by making a single rapid measurement using the technique of the present invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

LOUDSPEAKER DRIVER EQUIVALENT CIRCUIT

Figure 1:
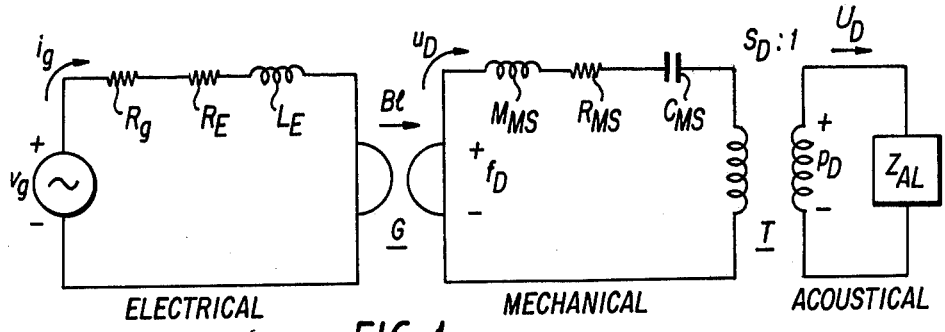
FIG. 1 illustrates an electro-mechano-acoustical circuit for a moving-coil loudspeaker driver according to the present invention.

The basic electro-mechano-acoustical circuit of a moving coil loudspeaker driver is known in the art. These prior art circuit models, however, use mobility type circuits in the mechanical and acoustical parts of the model. Because most analyses on the circuits are performed after a dual or impedance type of circuit has been formed, it is convenient to revise the model so that only impedance type circuits are used. This is possible if a gyrator model of the driver voice coil and magnet is used rather than the conventional ideal transformer. FIG. 1 illustrates such a circuit model. The circuit is divided into three parts: electrical, mechanical, and acoustical. The electrical part shows the driver connected to a generator with open circuit voltage $v_g$, output impedance $R_g$, and output current $i_g$. $R_E$ and $L_E$ are the voice-coil resistance and inductance, respectively. A gyrator G with impedance Bl couples the electrical circuit to the mechanical circuit, where B is the magnetic flux density in the air gap and l is the length of voice coil wire that cuts this uniform magnetic field.

In the mechanical part of the circuit, force is equivalent to voltage and velocity is equivalent to current. The force $f_D$ is the force generated on the voice coil by the current $i_g$ and the velocity $u_D$ is the velocity with which the voice coil moves. The elements $M_{MS}$, $R_{MS}$, and $C_{MS}$ are the total mechanical mass, resistance, and compliance, respectively, that are associated with the driver voice coil, cone, and suspension. The mechanical circuit is connected to the acoustical circuit by an ideal transformer T with a turns ratio of $S_D$:1, where $S_D$ is the effective piston area of the driver diaphram. In the acoustical part of the circuit, pressure is equivalent to voltage and volume velocity is equivalent to current. The pressure $p_D$ is the acoustic pressure at the driver cone and the volume velocity $U_D$ is the volume velocity emitted. The impedance $Z_{AL}$ is the series combination of the acoustical impedances seen by the front and rear of the driver cone. At and near the low frequencies of resonance exhibited by most drivers, the air load impedance $Z_{AL}$ in FIG. 1 is replaced by a single inductor which represents the air load mass on the driver diaphragm. In loudspeaker parameter measurements, it is standard practice to reflect this inductor into the mechanical circuit and add it to $M_{MS}$ so that $M_{MS}$ becomes the mechanical mass of the driver diaphragm including air load.

Figure 2:
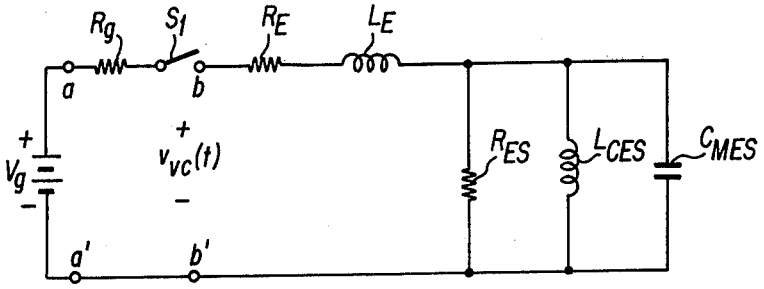
FIG. 2 illustrates an electrical equivalent circuit model of the circuit shown in FIG. 1.

The electrical equivalent circuit is formed by reflecting all elements in the circuit of FIG. 1 into the electrical part of the circuit as shown to the right of termals b–b′ in FIG. 2, where:

$$C_{MES}=M_{MS}/B^2l^2 \quad (1)$$

$$R_{ES}=B^2l^2/R_{MS} \quad (2)$$

$$L_{CES}=B^2l^2C_{MS} \quad (3)$$

The low frequency, small-signal parameters of the driver are related to these elements by the equations:

$$\omega_S=1/\sqrt{L_{CES}C_{MES}} \quad (4)$$

$$Q_{ES}=\omega_S R_E C_{MES} \quad (5)$$

$$Q_{MS}=\omega_S R_{ES} C_{MES} \quad (6)$$

$$V_{AS}=\rho_o c^2 S_D^2 L_{CES}/B^2l^2 \quad (7)$$

where $\omega_S$ is the free-air frequency of resonance in radians/sec, $Q_{ES}$ is the electrical quality factor, $Q_{MS}$ is the mechanical quality factor, and $V_{AS}$ is the acoustical compliance of the driver suspension expressed as an equivalent volume of air. In Equation (7), $\rho_o$ is the density of air and c is the velocity of sound in air. A fourth driver parameter is often defined. This is the total quality factor which is given by:

$$Q_{TS}=Q_{ES}Q_{MS}/Q_{ES}+Q_{MS} \quad (8)$$

TIME DOMAIN RESPONSE OF THE ELECTRICAL CIRCUIT TO A CURRENT STEP

In FIG. 2, the signal source has been replaced by a DC source of voltage $V_g$ in series with a known resistor of value $R_g$. A switch $S_1$ is connected between the source and the loudspeaker voice coil. The transient voltage signal generated in the voice coil when this switch is opened is the signal from which the loudspeaker parameters are calculated.

The first step in the measurement technique of the present invention is the determination of the DC voice coil resistance $R_E$. After the switch $S_1$ is closed and all transients have decayed to zero, the DC source current that will flow in the voice coil is given by:

$$I_{go}=V_g/R_g+R_E=V_g-V_{vc}/R_g \quad (9)$$

where $V_{vc}$ is the DC voltage across the voice coil. This equation can be resolved for $R_E$ to obtain:

$$R_E=V_{vc}R_g/V_g-V_{vc} \quad (10)$$

At some time, denoted by t=0, the switch $S_1$ in FIG. 2 is opened. It follows from a straightforward analysis that the transient voltage generated across the voice-coil terminals is given by:

$$v_{vc}(t)=-L_E I_{go}\delta(t)-Ae^{-\alpha t}\sin\omega_d t \quad (11)$$

where $\delta(t)$ is the unit impulse function. This impulse in voltage is caused by the voice-coil inductance $L_E$ which must dissipate its stored energy because it is abruptly open circuited. The exponentially damped sinusoidal component of $v_{vc}(t)$ is the voltage induced by the motion of the voice coil. The parameters A, $\alpha$, and $\omega_d$ in the equation are given by:

$$A=I_{go}/\omega_d C_{MES} \quad (12)$$

$$\alpha=1/2R_{ES}C_{MES} \quad (13)$$

$$\omega_d=\sqrt{\omega_S^2-\alpha^2} \quad (14)$$

where $\omega_S$ is the free-air frequency of resonance given by Equation (4). It follows from these relations that if A, $\alpha$, and $\omega_d$ can be determined from a measurement of $v_{vc}(t)$, then the circuit elements $R_{ES}$, $L_{CES}$, and $C_{MES}$ can be calculated. A method for determining A, $\alpha$, and $\omega_d$, based on a linear predictive analysis of the voice-coil voltage, is described below. With the calculated values of $R_E$, $R_{ES}$, $L_{CES}$, and $C_{MES}$, Equations (4)–(6) can be used to calculate $\omega_S$, $Q_{ES}$, and $Q_{MS}$.

To determine $V_{AS}$, the volume compliance of the driver, it is necessary to make a second measurement. This measurement is made with the driver mounted on a tightly sealed box having a known volume $V_B$. Such a box is referred to hereinafter as a compliance box. The equivalent circuit of the driver mounted on this box is the same as that given in FIG. 2 except that the element values are different. A determination of these values from a second measurement of $v_{vc}(t)$ can be used to calculate the driver frequency of resonance on the box $\omega_{CT}$ and the electrical quality factor on the box $Q_{ECT}$ from Equations (4) and (5), respectively. $V_{AS}$ is then given by:

$$V_{AS}=V_B[\omega_{CT}/\omega_S\, Q_{ECT}/Q_{ES}-1]. \quad (15)$$

LINEAR PREDICTIVE ANALYSIS

In order to apply the techniques of digital signal analysis to the measurement procedure disclosed above, it is necessary to describe the voice-coil voltage response as a discrete-time sequence of samples. In an implementation of the procedure, it is difficult, if not impossible, to sample the impulse that occurs at the time origin of the voice-coil step response. Therefore, it will be assumed that the sampling for $t>0$ is begun at some time $t=\sigma$, where $0<\sigma<T$, and T is the sampling period. This accounts for any asynchrony between the operation of the switch and the sampling times. Thus the discrete-time model for the sequence of samples of the step response is:

$$\begin{aligned} v_{vc}(n) &= v_{vc}(nT+\sigma) \\ &= -Ae^{-\alpha(nT+\sigma)}\sin\omega_d(nT+\sigma),\ n \geqq 0 \end{aligned} \quad (16)$$

where n is an integer. Although the impulse does not appear in this equation, evidence of it does appear in the experimental data to be presented. However, in the analyses performed on these data, approximately the first half-cycle of data is discarded in order to eliminate all effects of the impulse and any nonlinearities caused by the large initial displacement of the voice coil. This also eliminates errors caused by the assumption that the voice coil and magnet can be modeled as having a lossless inductance. In reality this inductance is very lossy and it cannot dissipate its stored energy instantaneously.

The z-transform of the discrete time sequence given by Equation (16) is:

$$V_{vc}(z)=b_o+b_1z^{-1}/1+a_1z^{-1}+a_2z^{-2} \quad (17)$$

where the coefficients of z are given by:

$$b_o=-Ae^{-\alpha\sigma}\sin\omega_d\sigma \quad (18)$$

$$b_1=-Ae^{-\alpha(T+\sigma)}\sin\omega_d(T-\sigma) \quad (19)$$

$$a_1=-2e^{-\alpha T}\cos\omega_d T \quad (20)$$

$$a_2=e^{-2\alpha T} \quad (21)$$

It follows from these relations that if the coefficients of z are determined, it is possible to calculate A, $\alpha$ and $\omega_d$. Estimates of the coefficients $a_1$ and $a_2$ can be obtained from a linear predictive analysis of the measured discrete time sequence. From their values, $\alpha$ and $\omega_d$ can be calculated from Equations (20) and (21). The quantity A can be determined by matching the energy of the measured sequence to that which would be predicted from the model with the given values of $\alpha$ and $\omega_d$.

By making use of the time delay property of z-transform theory, it follows from Equation (17) that the sequence $v_{vc}(n)$ must satisfy the difference equation:

$$v_{vc}(n)+a_1v_{vc}(n-1)+a_2v_{vc}(n-2)=0 \text{ for } n\geqq 2 \quad (22)$$

It follows from this equation that for $n\geqq 2$, $v_{vc}(n)$ can be exactly predicted from only the two immediate past samples. It is not desired, however, to predict samples of the step response because these are the measured quantities. Instead, the fact that the sampled step response model satisfies such a difference equation suggests that estimates of $a_1$ and $a_2$ can be obtained by seeking a second order linear predictor, i.e., by seeking a set of coefficients that minimize the mean-square prediction error that is defined by:

$$\epsilon^2=\sum_{n=n_1}^{n_1+N-1}[\hat{v}_{vc}(n)+\beta_1\hat{v}_{vc}(n-1)+\beta_2\hat{v}_{vc}(n-2)]^2 \quad (23)$$

where $\hat{v}_{vc}(n)$ is the sequence of samples of the measured voice-coil step response. In Equation (23), $\beta_1$ and $\beta_2$ are predictor coefficients which are to be found so as to minimize $\epsilon^2$; $n_1$ is an integer such that $n_1\geqq 2$ as suggested by Equation (22); and N is the total number of samples involved in the analysis. This approach to the analysis is called the covariance method of linear predictive analysis.

The prediction error $\epsilon^2$ is minimized when $\partial\epsilon^2/\partial\beta_1=0$ and $\partial\epsilon^2/\partial\beta_2=0$. For these conditions to hold, it follows that $\beta_1$ and $\beta_2$ must satisfy the equation:

$$\phi_{11}\beta_1+\phi_{12}\beta_2=-\phi_{01} \quad (24)$$

$$\phi_{21}\beta_1+\phi_{22}\beta_2=-\phi_{02} \quad (25)$$

where the coefficients $\phi_{ij}$ are computed from:

$$\phi_{ij}=\sum_{n=n_1}^{n_1+N-1}\hat{v}_{vc}(n-i)v_{vc}(n-j)\ i=0,1,2 \text{ and } j=1,2 \quad (26)$$

Equations (24) and (25) can easily be solved in closed form for $\beta_1$ and $\beta_2$ as follows:

$$\beta_1=\frac{\begin{vmatrix}-\phi_{01} & \phi_{12}\\ -\phi_{02} & \phi_{22}\end{vmatrix}}{\begin{vmatrix}\phi_{11} & \phi_{12}\\ \phi_{21} & \phi_{22}\end{vmatrix}} \quad (27)$$

$$\beta_2=\frac{\begin{vmatrix}\phi_{11} & -\phi_{01}\\ \phi_{21} & -\phi_{02}\end{vmatrix}}{\begin{vmatrix}\phi_{11} & \phi_{12}\\ \phi_{21} & \phi_{22}\end{vmatrix}} \quad (28)$$

If the measured samples $\hat{v}_{vc}(n)$ exactly fit the model, i.e., $v_{vc}(n)=v_{vc}(n)$ where $\hat{v}_{vc}(n)$ is given by Equation (16), then it follows from Equation (22) that the solution of Equations (24) and (25) will be $\beta_1=a_1$ and $\beta_2=a_2$ and the mean-squared prediction error will be identically zero. In practice, however, measurement noise, nonlinearities in the driver, and inaccuracies in the model will prevent an ideal result. But the values obtained lead to a least squares fit to the measured data that can be used to accurately estimate the parameters $\alpha$ and $\omega_d$. From Equations (20) and (21), it follows that these estimates are:

$$\alpha=-\frac{1}{2T}\ln(\beta_2) \quad (29)$$

$$\omega_d=\frac{1}{T}\cos^{-1}\left[\frac{-\beta_1}{2\sqrt{\beta_2}}\right] \quad (30)$$

The amplitude parameter A can be estimated in several ways. One approach is to simply equate the energy of the measured sequence $v_{vc}(n)$ to the energy of the model sequence $\hat{v}_{vc}(n)$. This approach leads to the equation:

$$A = \left[ \frac{\sum_{n=n_1}^{n_1+N-1} \hat{v}_{vc}^2(n)}{\sum_{n=n_1}^{n_1+N-1} [e^{-\alpha(nT+\sigma)}\sin\omega_d(nT+\sigma)]^2} \right] \quad (31)$$

where $\alpha$ and $\omega_d$ are given by Equations (29) and (30). Another approach is to find the value of A that minimizes the mean-square error:

$$\epsilon_A^2 = \sum_{n=n_1}^{n_1+N-1} [\hat{v}_{vc}(n) + Ae^{-\alpha(nT+\sigma)}\sin\omega_d(nT+\sigma)]^2 \quad (32)$$

again with $\alpha$ and $\omega_d$ equal to the estimated values. The value of A that minimizes $\epsilon_A^2$ is given by:

$$A = -\left[ \frac{\sum_{n=n_1}^{n_1+N-1} \hat{v}_{vc}(n)e^{-\alpha(nT+\sigma)}\sin\omega_d(nT+\sigma)}{\sum_{n=n_1}^{n_1+N-1} [e^{-\alpha(nT+\sigma)}\sin\omega_d(nT+\sigma)]^2} \right] \quad (33)$$

To evaluate either Equation (31) or (33), it is necessary to estimate $\sigma$, the offset between the sampling times and the instant of the opening of switch $S_1$. This can be done by simply locating the samples that span the interval containing the second zero consisting of $v_{vc}(n)$. At reasonably high sampling rates, $\sin \omega_d(t+\sigma)$ can be assumed to be a straight line between these two samples, and thus linear interpolation suffices to find the position of the zero crossing between them. This knowledge is sufficient to permit the alignment of the model sequence $v_{vc}(n)$ with the measured sequence $\hat{v}_{vc}(n)$.

MEASUREMENT PROCEDURE AND MEASUREMENT EXAMPLES

Figure 3:
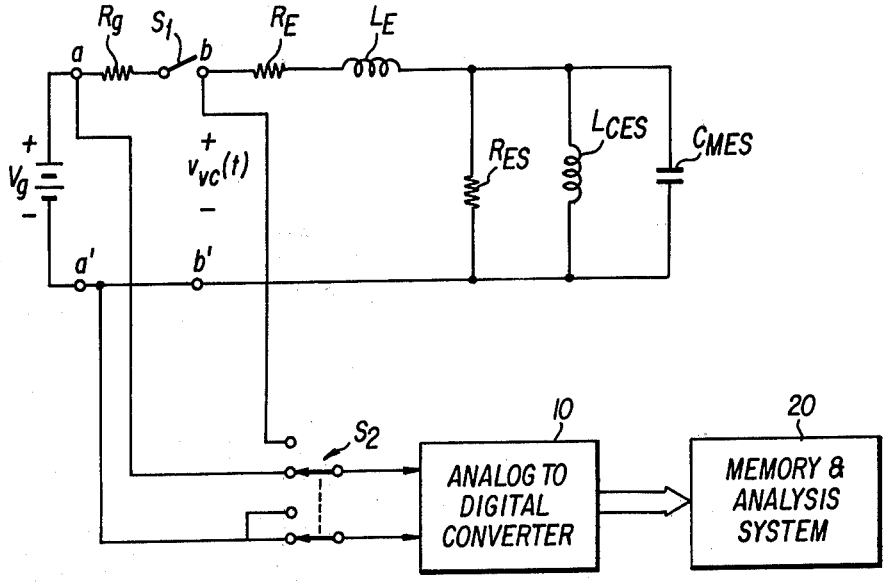
FIG. 3 illustrates the interconnection of the circuit of FIG. 2 with a digital data acquisition circuit according to the present invention.

An automated measurement system based upon the above described circuit model and analysis will now be described. FIG. 3 illustrates the interconnection of the loudspeaker driver circuit of FIG. 2 with a system for evaluating the analysis equations. This system will be referred to as the signal processing system. In FIG. 3, the signal processing system is shown as including an analog to digital converter 10 coupled to the loudspeaker circuit at terminals a—a′ and b—b′ through a suitable switching means diagramatically illustrated as switch $S_2$. The analog to digital converter samples the voltage levels appearing at the terminals at a known rate. The digital samples from the analog to digital converter 10 are supplied to a memory and analysis system 20. The samples are recorded and the necessary calculations are performed on the recorded samples in unit 20. The analog to digital converter should have at least 12-bits of amplitude resolution so as to accurately represent the transient response samples. The sampling rate should be 10–20 times the natural frequency of the loudspeaker driver. In the results to be described, the sampling rate was 500 samples/sec. The signal processing system must be capable of storing the samples corresponding to a time interval of not more than 1–2 sec. Thus a memory of less than 1000 12-bit words is required to store the digitized waveforms required for the analysis. The remainder of the signal processing system consists of a device for implementing the computations specified by the above analysis. This can be achieved with a microprocessor, since the computations are relatively simple and they can easily be carried out in only a few seconds on even the simplest microprocessor. The required program can be stored in a read-only memory of only a few thousand words.

Figure 4:
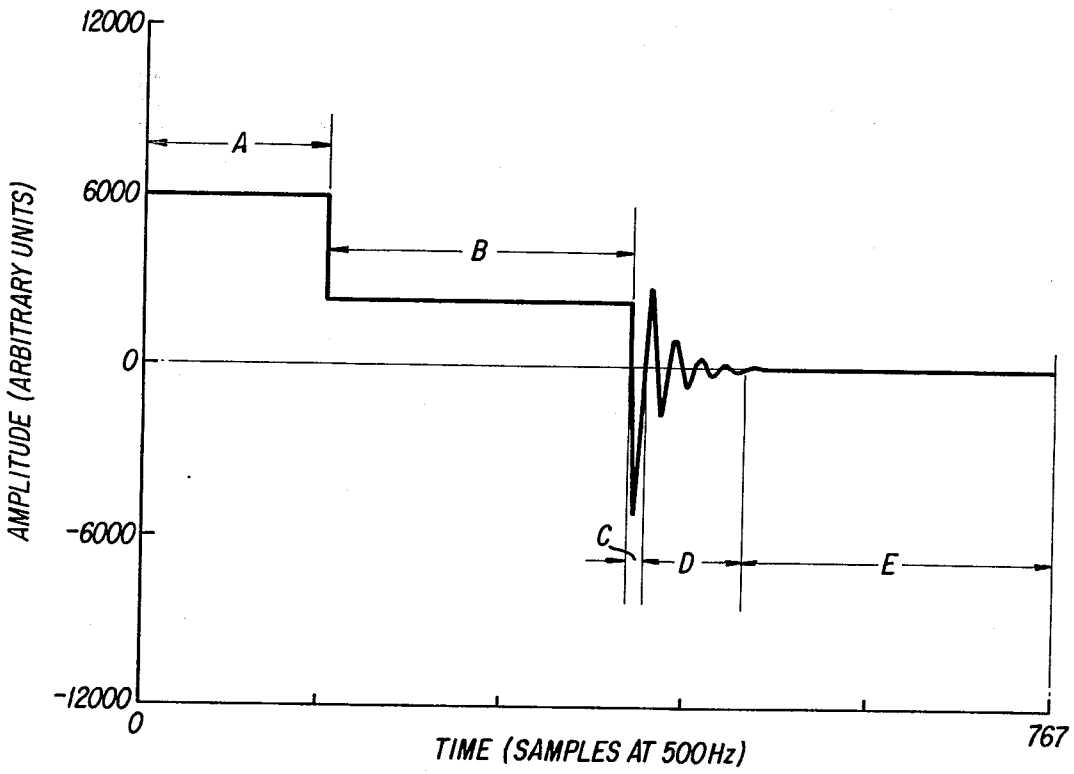
FIG. 4 illustrates typical measured voltage data obtained using the system of FIG. 3.

In FIG. 3, with switch $S_1$ closed and approximately 200 mA of DC current through the voice coil, the analog-to-digital converter 10 is used to sample the voltage at terminals a—a′ in FIG. 2 for about 0.5 second. Then the A-to D converter 10 is switched via $S_2$ to terminals b—b′, also for about 0.5 second. With the A-to-D converter still connected to terminals b—b′, the switch $S_1$ is opened and the transient voltage waveform that occurs is sampled for about 1 second. A typical sequence of samples measured from a commercially available 12-inch loudspeaker driver is shown in FIG. 4. (The samples are connected by straight lines for convenience in plotting).

The units of amplitude depend upon the relationship between numbers in the memory and analysis system 20 and the voltage at the input to the A-to-D converter 10. It can be seen, however, that amplitude quantities always enter as ratios in the previously described analysis equations so that it is not necessary to precisely calibrate the A-to-D converter.

The use of 200 mA initial current in the voice coil was a compromise in the experimental verification. This is definitely not "small signal" for many drivers and can cause a temporary creep in the zero or rest position of the cone. For the experimental system which was set up for general signal processing experiments, less than 200 mA of initial current did not make adequate use of the dynamic range of the A-to-D converter and resulted in a poor signal-to-noise ratio in the measured data. However, in an implementation of this invention, it would be possible to adjust the voltage range of the analog to digital converter so that much lower initial currents could be used while still utilizing the full dynamic range of the analog to digital converter.

The DC source voltage $V_g$ (in arbitrary units) is estimated as the average of the sequence values in the interval labled A in FIG. 4. Likewise, the DC voltage at the voice-coil terminals $V_{vc}$ is estimated as the average of the sequence values in interval B. These estimates of $V_g$ and $V_{vc}$ are used in Equation (10) and (9) to calculate the voice-coil resistance $R_E$ and the current $I_{go}$.

The interval labeled C in FIG. 4 is the time interval from the time of opening of the switch $S_1$ to the next zero crossing of the waveform. This interval is not used in the estimation of the loudspeaker parameters in order to avoid problems that might be caused by the voltage impulse due to $L_E$. Experience with the measurement procedure has shown that this time interval seems also to be influenced by nonlinear effects which are apparently caused by the large initial displacement of the voice coil and the effects of modeling the inductance of the voice coil and magnet as a lossless inductor. Thus, both of these effects are eliminated by omitting interval C from the analysis.

The interval labeled D in FIG. 4 is used in the linear predictive analysis. This interval extends from the second zero-crossing of the waveform for as many samples as desired. The basic equations for this analysis are Equations (26), (27) and (28). In these Equations, the lower limit of summation is denoted by $n_1$ where $n_1 \geqq 2$.

Figure 5:
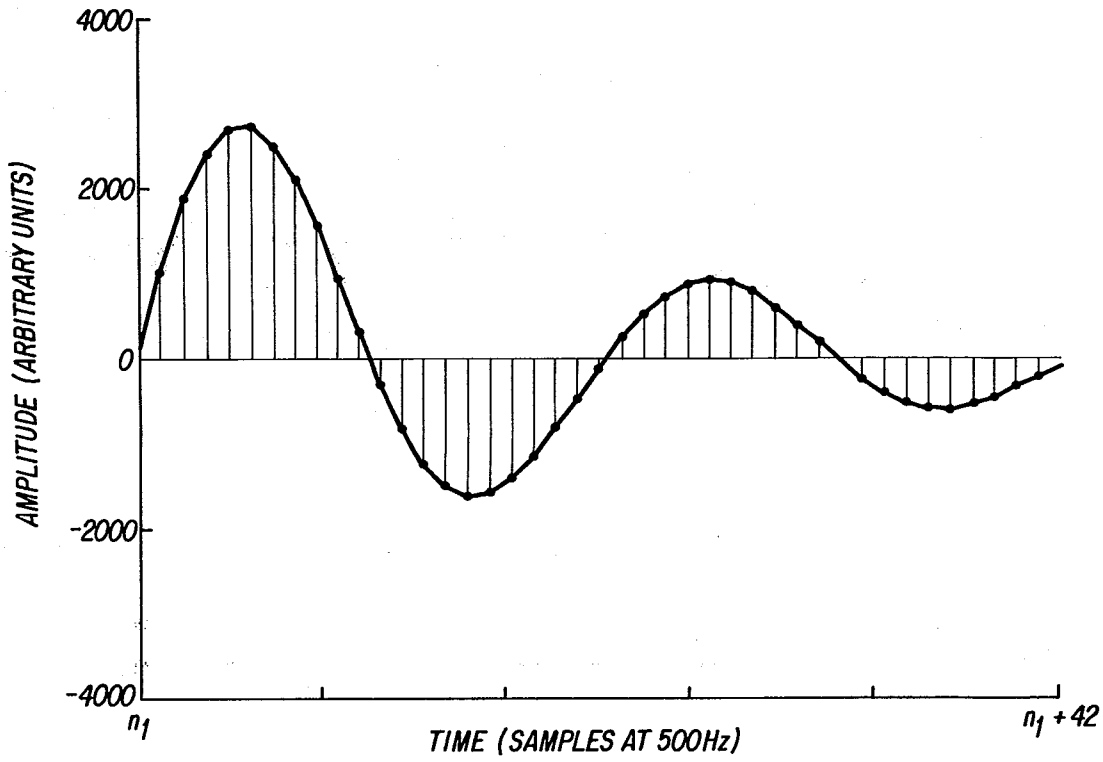
FIG. 5 illustrates a comparison of the measured data in interval D of FIG. 4 with a sequence of samples calculated according to the present invention.

In implementing the analysis, $n_1$ is the sample index of the first sample past the second zero-crossing. The extent of the interval, i.e., the value of N, is arbitrary. However, it is sufficient to use only two or three oscillations of the step response as depicted in FIG. 5. Here the solid curve is the sequence of measured step response values connected by straight line for plotting. In this particular case N=43. The predictor parameters $\beta_1$ and $\beta_2$ are estimated from this data, and then $\alpha$ and $\omega_d$ are estimated using Equations (29) and (30). Then using the estimated values of $\alpha$ and $\omega_d$, the parameter A is estimated using either Equation (31) or (33). The vertical lines in FIG. 5 represent the model sequence $v_{vc}(n)$ as estimated from the measured data. It is evident that the model fits the measured data very well.

The interval labeled E in FIG. 4 is the interval after the transient step response has died out. This interval is used to estimate the DC offset that may be present in the A-to-D converter. The average value of samples in this interval is subtracted from the entire waveform of FIG. 4 as a correction for the DC offset. It is important to do this because the DC offset affects both the estimation of the predictor parameters $\beta_1$ and $\beta_2$ and the estimation of the time shift $\sigma$.

Once the parameters $\alpha$, $\omega_d$, and A are obtained, then $C_{MES}$ can be obtained from Equation (12). Then $R_{ES}$ can be obtained from Equation (13), $\omega_S$ can be obtained from Equation (14), and $L_{CES}$ can be obtained from Equation (4). From these computed values, it is then possible to compute $Q_{ES}$, $Q_{MS}$, and $Q_{TS}$ using Equations (5), (6), and (8), respectively.

Alternatively, $Q_{ES}$ may be calculated without the intermediate step of calculation $C_{MES}$, $R_{MES}$, and $L_{CES}$ by combining Equations (12) and (14) with equation (5) to produce the following:

$$Q_{ES}=I_{go}R_E/\omega_d A\sqrt{\omega_d^2+\alpha^2} \quad (34)$$

Similarly, $Q_{MS}$ may be calculated directly by combining equation (13) and (14) with equation (6) as follows:

$$Q_{MS}=1/2\alpha\sqrt{\omega_d^2+\alpha^2} \quad (35)$$

The equivalent volume of air $V_{AS}$ can also be computed using Equation (7) if the area of the driver $S_D$ and the Bl product are known. In general, this will not be the case. However, $V_{AS}$ can be calculated using Equation (15) by repeating the measurements with the loudspeaker driver mounted on an air-tight compliance box of known volume.

The small-signal parameters of several drivers have been measured and compared to the values obtained using prior art techniques. Good agreement was obtained in each case with the exception that $Q_{MS}$ consistently calculated smaller using the transient method. The cause of this discrepancy is not known, and further research is needed to determine which technique is more accurate. A comparison of the parameters measured for a particular driver by both the transient and sinusoidal techniques is given in Table I.

Obviously, numerous (additional) modifications and variations of the present invention are possible in light of the above teachings. It is therefore to be understood that within the scope of the appended claims, the invention may be practiced otherwise than as specifically described herein. It may also be pointed out that there are many other electro-mechanical devices that can be represented with good accuracy by the circuit model of FIG. 2. Notable examples are the seismometers or geophones used to detect earthquakes and prospect for oil. The basic principles described above therefore apply directly to the calibration of such devices and an automatic device based upon these principles would have application in this area as well. Indeed, by a straightforward generalization of the basic analysis equations, systems of higher order than 2 could be automatically analyzed.

TABLE I

| | Philips AD122250/W8 12" Woofer | | | |
|---|---|---|---|---|
| Parameter | Sinusoidal Measurement | Transient Measurement #1 | Transient Measurement #2 | Average |
| $f_S$ | 23.2 Hz | 23.4 Hz | 23.6 Hz | 23.5 Hz |
| $Q_{ES}$ | .34 | .32 | .36 | .34 |
| $Q_{MS}$ | 3.1 | 2.5 | 2.8 | 2.6 |
| $V_{AS}$ | 10.6 $ft^3$ | — | — | 10.0 $ft^3$ |

What is claimed as new and desired to be secured by Letters Patent of the United States is:

1. A method for measuring the small-signal parameters of a moving-coil electromagnetic transducer driver, comprising:
   - mounting said driver in free air;
   - coupling the electrical input terminals of said driver to a series circuit including a switching means, a source of DC voltage, and a series resistance;
   - closing said switching means such that a DC current flows through said series circuit including said driver;
   - measuring the DC source voltage $V_g$ appearing across the output terminals of said DC voltage source;
   - measuring the DC voltage $V_{vc}$ appearing across the terminals of said driver;
   - calculating the voice coil resistance $R_E$ of said driver and the steady state current $I_{go}$ flowing in said series circuit using said measured voltages $V_g$ and $V_{cc}$;
   - opening said switch;
   - measuring the AC voltage $v_{vc}(t)$ appearing across the terminals of said driver as a function of time;
   - determining the amplitude coefficient A, the attenuation factor $\alpha$, and the frequency $\omega_d$ of said measured AC voltage; and
   - calculating the free-air frequency of resonance $\omega_S$, the electrical quality factor $Q_{ES}$, the mechanical quality factor $Q_{MS}$, and the total quality factor $Q_{TS}$ for said driver using said amplitude coefficient, said attenuation factor, and frequency $\omega_d$.

2. A method for measuring the small-signal parameters of a moving-coil electromagnetic transducer driver as recited in claim 1, further comprising:
   - mounting said driver on an air-tight compliance box of a known volume;
   - repeating said measuring and calculating steps; and
   - calculating the acoustical compliance $V_{AS}$ of the driver suspension expressed as an equivalent volume of air.

3. A method for measuring the small-signal parameters of a moving-coil electromagnetic transducer driver as recited in claim 1 wherein the measurement of said AC voltage $v_{vc}(t)$ appearing across the terminals of said driver, comprises:
   - coupling an Analog-to-Digital converter across the terminals of said driver;
   - sampling said AC voltage $v_{vc}(t)$ at a known rate; and recording said samples.

4. A method for measuring the small-signal parameters of a moving-coil electromagnetic transducer driver as recited in claim 3, wherein:

said attenuation factor $\alpha$ of said AC voltage is determined from said recorded samples using the equation:

$$\alpha = 1/2T \ln(\beta_2)$$

said frequency $\omega_d$ of said AC voltage is determined from said recorded samples using the equation:

$$\omega_d = \frac{1}{T}\cos^{-1}\left[\frac{-\beta_1}{2\sqrt{\beta_2}}\right]$$

where:

$$\beta_1 = \frac{\begin{vmatrix} -\phi_{01} & \phi_{12} \\ -\phi_{02} & \phi_{22} \end{vmatrix}}{\begin{vmatrix} \phi_{11} & \phi_{12} \\ \phi_{21} & \phi_{22} \end{vmatrix}}$$

$$\beta_2 = \frac{\begin{vmatrix} \phi_{11} & -\phi_{01} \\ \phi_{21} & -\phi_{02} \end{vmatrix}}{\begin{vmatrix} \phi_{11} & \phi_{12} \\ \phi_{21} & \phi_{22} \end{vmatrix}}$$

$$\phi_{ij} = \sum_{n=n_1}^{n_1+N-1} v_{vc}(n-i)v_{vc}(n-j) \quad i = 0, 1, 2; j = 1, 2$$

$V_{vc}(n)$ = Measured Samples

5. A method for measuring the small-signal parameters of a moving-coil electromagnetic transducer driver as recited in claim 3, wherein:

said amplitude coefficient A of said AC voltage is determined from said recorded samples using the equation:

$$A = \left[\frac{\sum_{n=n_1}^{n_1+N-1} V_{vc}^2(n)}{\sum_{n=n_1}^{n_1+N-1} [e^{-\alpha(nT+\sigma)}\sin\omega_d(nT+\sigma)]^2}\right]^{\frac{1}{2}}$$

where:

$v_{vc}(n)$=measured samples
$\alpha$=attenuation factor
T=sampling period
$\sigma$=time at which sampling was begun
$\omega_d$=frequency of said AC voltage.

6. A method for measuring the small-signal parameters of a moving-coil electromagnetic transducer driver as recited in claim 3 wherein:

said amplitude coefficient A of said AC voltage is determined from said recorded samples using the equation:

$$A = -\left[\frac{\sum_{n=n_1}^{n_1+N-1} v_{vc}(n)e^{-\alpha(nT+\sigma)}\sin\omega_d(nT+\sigma)}{\sum_{n=n_1}^{n_1+N-1} [e^{-\alpha(nT+\sigma)}\sin\omega_d(nT+\sigma)]^2}\right]$$

where:

$\hat{v}_{vc}(n)$=measured samples
$\alpha$=attenuation factor
T=sampling period
$\sigma$=time at which sampling was begun
$\omega_d$=frequency of said AC voltage.

7. A method for measuring the small-signal parameters of a moving-coil electromagnetic transducer driver as recited in claim 1, wherein:

said voice coil resistance $R_E$ of said driver is calculated using the equation:

$$R_E = V_{vc}R_g/V_g - V_{vc}$$

said steady state current $I_{go}$ is calculated using the equation:

$$I_{go} = V_g - V_{vc}/R_g$$

where:

$R_g$=series resistance of the series circuit
$V_g$=DC voltage measured across the terminals of said DC source
$V_{vc}$=DC voltage measured across the terminals of said driver.

8. A method for measuring the small-signal parameters of a moving-coil electromagnetic transducer driver as recited in claim 1, wherein:

said free-air frequency of resonance $\omega_S$ is calculated using the equation:

$$\omega_S = \sqrt{\omega_d^2 + \alpha^2}$$

said electrical quality factor $Q_{ES}$ is calculated using the equation:

$$Q_{ES} = I_{go}R_E/\omega_d A\sqrt{\omega_d^2 + \alpha^2}$$

said mechanical quality factor $Q_{MS}$ is calculated using the equation:

$$Q_{MS} = 1/2\alpha\sqrt{\omega_d^2 + \alpha^2}$$

said total quality factor $Q_{TS}$ is calculated using the equation:

$$Q_{TS} = Q_{ES}Q_{MS}/Q_{ES} + Q_{MS}$$

Where:

$R_E$=voice coil resistance
$I_{go}$=steady state current
A=amplitude coefficient of said measured AC voltage
$\alpha$=attenuation factor of said measured AC voltage
$\omega_d$=frequency of said measured AC voltage.

9. A method for measuring the small-signal parameters of a moving-coil electromagnetic transducer driver as recited in claim 2, wherein:

said acoustical compliance of the driver suspension expressed as an equivalent volume of air $V_{AS}$ is calculated using the equation:

$$V_{AS} = V_B\left[\frac{\omega_{CT}Q_{ECT}}{\omega_S Q_{ES}} - 1\right]$$

where:

$V_B$=volume of compliance box
$\omega_S$=free-air frequency of resonance
$\omega_{CT}$=driver frequency of resonance on said box
$Q_{ECT}$=electrical quality factor on said box.

* * * * *

UNITED STATES PATENT AND TRADEMARK OFFICE

CERTIFICATE OF CORRECTION

PATENT NO. : 4,284,860

DATED : August 18, 1981

INVENTOR(S) : W. Marshall Leach, Jr. et al

It is certified that error appears in the above—identified patent and that said Letters Patent is hereby corrected as shown below:

On the title page in item [54] DOMAN should be --DOMAIN--

In column 1, line 1, DOMAN should be --DOMAIN--.

Signed and Sealed this

*First* Day of *December 1981*

[SEAL]

*Attest:*

GERALD J. MOSSINGHOFF

*Attesting Officer* *Commissioner of Patents and Trademarks*